US005208947A

United States Patent [19]

Sanno et al.

[11] Patent Number: 5,208,947

[45] Date of Patent: May 11, 1993

[54] CLEARER FOR DRAFT ROLLERS

[75] Inventors: Hiroaki Sanno, Nonoichi; Hiroshi Nakayama, Kanazawa, both of Japan

[73] Assignee: Murao and Company Limited, Kanazawa, Japan

[21] Appl. No.: 845,426

[22] Filed: Mar. 5, 1992

[30] Foreign Application Priority Data

Mar. 14, 1991 [JP] Japan ..... 3-049645

[51] Int. Cl.[5] ..... D01H 5/60; D01H 5/64

[52] U.S. Cl. ..... 19/262; 19/245

[58] Field of Search ..... 19/245, 262, 265

[56] References Cited

U.S. PATENT DOCUMENTS

| | | | |
|---|---|---|---|
| 2,367,782 | 11/1944 | Truslow et al. | 19/245 |
| 2,730,770 | 1/1956 | Higginbotham et al. . | |
| 2,834,062 | 5/1958 | Toenniessen | 19/262 |
| 2,951,268 | 9/1960 | West | 19/262 |
| 4,317,261 | 3/1982 | Adamson | 19/265 |
| 4,370,781 | 2/1983 | Murao | 19/262 X |
| 4,706,339 | 11/1987 | Eder | 19/265 |
| 4,985,967 | 1/1991 | Stahlecker et al. | 19/262 X |

FOREIGN PATENT DOCUMENTS

| | | | |
|---|---|---|---|
| 0021272 | 1/1981 | European Pat. Off. . | |
| 1048523 | 11/1956 | Fed. Rep. of Germany | 19/265 |
| 1383460 | 2/1964 | France | 19/245 |
| 516406 | 2/1955 | Italy | 19/262 |
| 7307085 | 11/1974 | Netherlands | 19/265 |
| 510 | of 1861 | United Kingdom | 19/262 |
| 747959 | 4/1956 | United Kingdom . | |

*Primary Examiner*—Clifford D. Crowder
*Assistant Examiner*—John J. Calvert
*Attorney, Agent, or Firm*—Longacre & White

[57] ABSTRACT

A clearer for draft rollers is provided, wherein the material for a cloth guide urging a clearer cloth onto draft rollers is changed to an elastic element having an outer shell composed of a flexible sheet made of sponge, foam rubber, foam urethane, plastic, rubber and the like and containing gas, liquid, gel, sol, powder, fine particles, and the like disposed at the back of the clearer cloth where the clearer cloth does not directly urge the draft rollers, in an appropriate length corresponding to the draft rollers whereby the need for the work of changing the cloth guide position is eliminated even if the roller gauges between the draft rollers are changed, and which prevents scraps of fiber and dust from accumulating as floating fibers in the cloth guide.

7 Claims, 2 Drawing Sheets

PRIOR ART

CLEARER FOR DRAFT ROLLERS

BACKGROUND OF THE INVENTION

1. Field of the Invention

The present invention relates to a clearer device for draft rollers provided on spinning machinery, which is installed for removing scraps of fiber sticking to the surface of the draft rollers and more particularly to a cloth guide for urging a clearer cloth onto draft rollers for a type of clearer device wherein a clearer cloth is sequentially fed and the scraps of fiber sticking to the surface of the said clearer cloth is removed by combing.

2. Description of the Related Arts

As shown in FIG. 2, a cloth guide 14 has been screwed on a cloth plate 11 with screws 12 in the priot art. As a result, the position wherein the said cloth guide 14 is fixed must be changed frequently as roller gauges 15 between draft rollers 13 are changed depending on the types of fibers such as natual fibers, chamical and synthetic fibers, and various short and long fibers.

On the other hand, many pieces of spinning machinery are in general installed at a time to meet the demands for mass production capability realized by promoting use of large packages and enhancing the speed and performance. As a result, operators of spinning machinery spend a great amount of time in changing the roller gauges 15 between draft rollers and the position wherein the cloth guide 14 is fixed in response to frequent changes in the types of fibers processed. At the same time, there is always a rush for production of diversified items in small quantities in order to meet the demands in marketplace reflecting the consumers' liking which has been increasingly individualized in recent years. There is a tendency that the types of fibers must be changed more frequently in order to solve this critical problem, resulting in an increase in the time spent for such changing work.

In addition, there is a serious problem that scraps of fiber and dust accumulate as floating fibers in the cloth guide, and the floating fibers drop from the cloth guide and enter fiber products, leading to a reduction in the quality of the fiber products. Further, the accumulated scraps give many probelms to driving parts such as rotating parts of a clearer device and draft rollers.

SUMMARY OF THE INVENTION

It is an object of the present invention to provide a clearer for draft rollers which does not require the work for changing the position of a cloth guide when the roller gauges between the draft rollers are changed and which prevents scraps of fiber and dust from accumulating as floating fibers in the cloth guide.

The clearer has a configuration wherein the material for the conventional rigid metal cloth guides has been changed to an elastic element having an outer shell composed of a flexible sheet made of sponge, foam rubber, foam urethane, plastic, rubber and the like and containing gas, liquid, gel, sol, powder, fine particles, and the like disposed so that it abuts the back of the clearer cloth urging the draft rollers in an appropriate length corresponding to the draft rollers; and a sheet, thin plate or film of a metal or resin having excellent lubricating and abrasion resisting properties is formed on a sliding surface where the clearer cloth contacts the draft rollers by means of bonding, adhesive, or welding. Needless to say, when the said outer shell member itself has lubricating and abrasion resisting properties, it is not necessary to form the sheet, thin plate or film of a metal or resin having excellent lubricating and abrasion resisting properties by bonding, adhesive, or welding.

DETAILED DESCRIPTION OF THE PREFERRED EMBODIMENT

Figure 1:
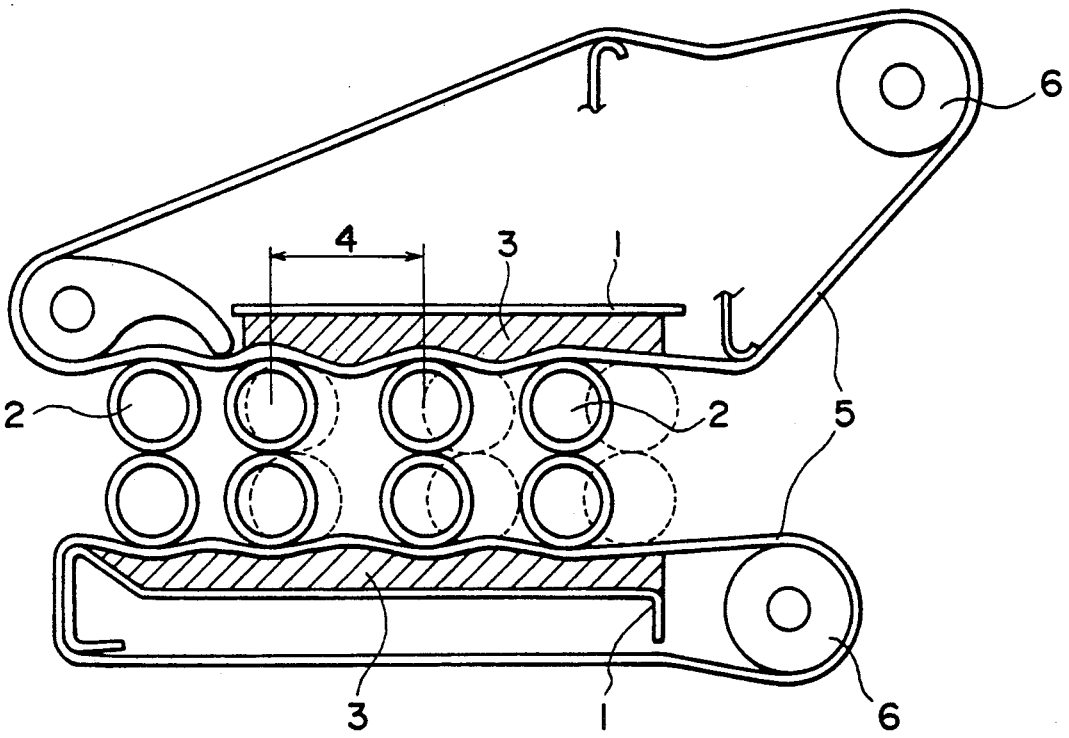
FIG. 1 is a configuration diagram showing the location of an elastic element of a clearer for draft rollers according to the present invention.
Figure 2:
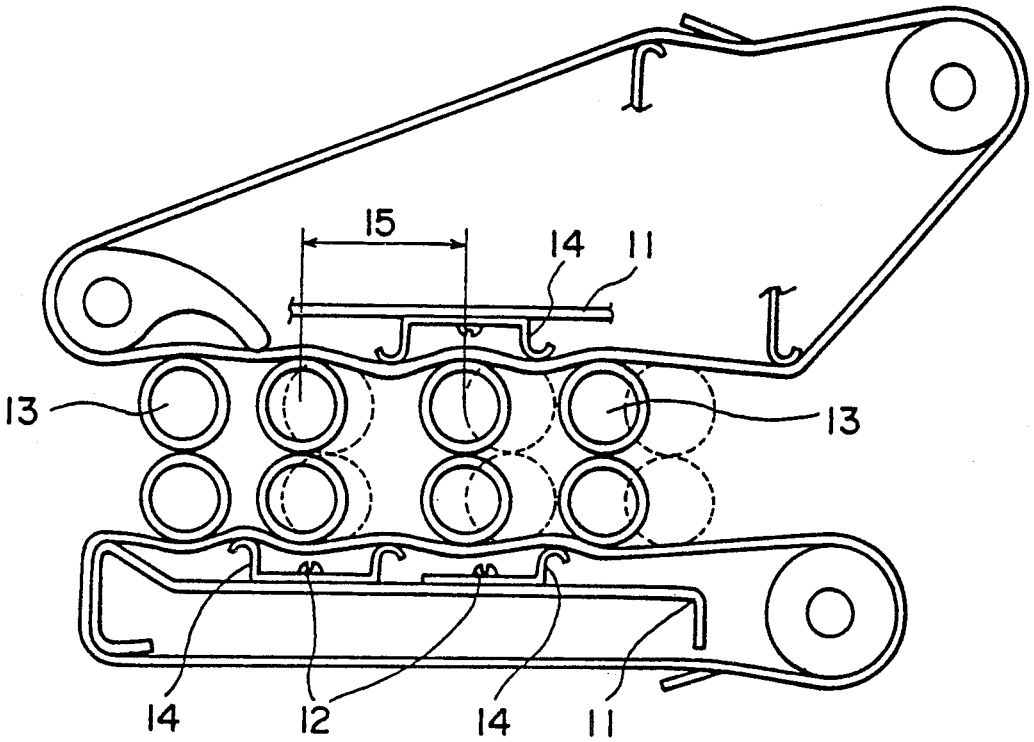
FIG. 2 is a configuration diagram showing a cloth guide of a conventional clearer for draft rollers.

An embodiment of the present invention will now be described in detail with reference to the drawings. FIG. 1 is a diagram showing an embodiment of a clearer for draft rollers according to the present invention. In the FIG., 1 represents a cloth plate of the body of the clearer. 2 represents draft rollers of a roving frame and the like. 3 represents a cloth guide wherein an elastic element having an outer shell composed of a flexible sheet made of sponge, foam rubber, foam urethane, plastic, rubber and the like and containing gas, liquid, gel, sol, powder, fine particles, and the like is disposed so that it abuts the back of a clearer cloth 5 in an appropriate length corresponding to the draft rollers; and a sheet, thin plate or film of a metal or resin having excellent lubricating and abrasion resisting properties is formed on a sliding surface where the clearer cloth 5 directly contacts the draft rollers 2 by means of bonding, adhesive, or welding. 6 represents a roller for driving the cloth.

In such a configuration, even if changes are made in the roller gauges 4 between the draft rollers 2 and the position wherein the cloth guide is fixed, as the type of the fiber processed is changed, the portions of the cloth guide which abut the draft rollers 2 are transformed to urge the draft rollers 2 with an appropriate urging force constantly if the clearer device is set as it is. As a result, performance similar to that of the conventional cloth guide is exhibited, and there is no accumulation of scraps of fiber and dust because the regions which have been vacant in the conventional cloth guide, are all filled with the elastic element 3.

If the entire surface of the elastic element of the cloth guide is smoothly coated with resin and the like, the accumulation of scraps of fiber and dust will not occur also in this region, whereby the reduction in the quality of fiber products due to the entrance of floating fibers can be avoided. Further, the driving of the clearer device and the driving parts such as the rotating parts of the draft rollers is stabilized.

FIG. 1 shows a specific embodiment. The the present invention is not limited to FIG. 1 and can be similarly implemented with partial changes in the structure or design thereof in accordance with the teachings described above and later.

With the configuration as described above, there is no need for the work of changing the cloth guide position even if there are changes in the roller gauges 4 between the draft rollers, and the reduction in the quality of fiber products due to the entrance of scraps of fiber and dust can be avoided. Moreover, since the sliding surface of the cloth guide with which the clearer cloth 5 contacts, is formed from a sheet, thin plate or film of a metal or resin having excellent lubricating and abrasion resisting properties by means of bonding, adhesive, or welding, there are many advantages including the fact that the abrasion on the surface of the clearer cloth 5 can be avoided.

What is claimed is:

1. A clearer for clearing draft rollers comprising a cloth guide urging a clearer cloth into contact with the draft rollers, said clearer further comprising elastic means for substantially conforming to a space laterally bounded between a cloth plate and said clearer cloth.

2. The clearer according to claim 1 wherein said elastic means comprises a flexible outer shell filled with a fluid.

3. The clearer according to claim 1 wherein said elastic means comprises a flexible outer shell surrounding an elastically deformable member.

4. The clearer according to claim 1 further comprising:

antifriction means for reducing sliding friction between said clearer cloth and said elastic means.

5. The clearer according to claim 4 wherein said antifriction means is interposed at an interface between said clearer cloth and said elastic means.

6. The clearer according to claim 5 wherein said antifriction means comprises a thin layer of metal adapted to lubricate and resist abrasion.

7. The clearer according to claim 5 wherein said antifriction means comprises a thin film of resin adapted to lubricate and resist abrasion.

* * * * *